United States Patent [19]

Shelby et al.

[11] 4,200,905

[45] Apr. 29, 1980

[54] DETACHABLE HINGE MECHANISM FOR LUMINAIRE

[75] Inventors: Billy L. Shelby; William C. Moore, both of Memphis, Tenn.

[73] Assignee: International Telephone and Telegraph Corporation, New York, N.Y.

[21] Appl. No.: 839,431

[22] Filed: Oct. 5, 1977

[51] Int. Cl.[2] ..... F21V 23/04

[52] U.S. Cl. ..... 362/396; 362/285; 362/145

[58] Field of Search ..... 362/288, 285, 287, 145, 362/147, 396, 404, 406, 408

[56] References Cited

U.S. PATENT DOCUMENTS

| | | | |
|---|---|---|---|
| 3,219,812 | 11/1965 | Turner | 362/285 |
| 3,348,035 | 10/1967 | Franklin et al. | 362/285 |
| 3,654,453 | 4/1972 | Jablonski | 362/374 |

*Primary Examiner*—Richard E. Schafer

*Assistant Examiner*—J. L. Barr

*Attorney, Agent, or Firm*—James R. Raden; Marvin M. Chaban

[57] ABSTRACT

A hinge mechanism for a luminaire for outdoor lighting which allows the lower housing including the lamp refractor to be pivoted to a position enabling access to the luminaire interior. When it is desired that the lower housing be detached, the hinge retainer is released to permit detachment of the lower housing. The hinge mechanism includes a transverse rod resting in a trough formed by one or more channel supports. To prevent the rod from being removed from the channel, a U-shaped spring holder is held in a position where each U leg normally extends over the opening of the hinge channel support. These spring holders retain the channel in the trough. To detach the hinge, the base of the U is manually grasped and retracted to withdraw the spring legs from its extending position. The rod in channel engagement may be detached to remove the refractor housing from the luminaire.

8 Claims, 8 Drawing Figures

DETACHABLE HINGE MECHANISM FOR LUMINAIRE

BACKGROUND OF THE INVENTION

In the field of street and roadway outdoor lighting, enclosed luminaires are well-known. Such luminaires include a main housing enclosing a lamp, ballast and reflector. The main housing provides the luminaire mounting support with hardware securing the luminaire in a slip fitter or bracket on a mast which may be disposed generally horizontally. Hinged to the main housing is a lower housing including a nest for a bowl-shaped refractor. The hinge may be at either the rear end of the main housing at the end adjacent the mast mounting, or at the front end, in either instance allowing access to the luminaire interior. Hinging the mounting end is shown by U.S. Pat. No. 3,219,812 issued Nov. 23, 1965 to C. E. Turner.

Luminaires of this general design are shown by such patents as U.S. Pat. No. 3,761,781 issued Sept. 25, 1973; and 3,652,047 issued Mar. 28, 1972 to G. N. Starr, and Design D 206,240 issued Nov. 15, 1966 to S. Rutter.

Such luminaires are standard in the lighting industry and have been so, for at least ten years.

When access to the interior of the luminaire is desired, a latch holding one end (front or back) is released and the lower housing and refractor are pivoted downwardly to an open position in which the lower housing depends from its hinge mounting. The lamp, ballast, reflector and electrical connections are exposed for inspection, servicing and/or repair. The hinge connection may conventionally be detached, if desired for removal of the lower housing.

SUMMARY OF THE INVENTION

In a luminaire of the type described, the main housing preferably has one or more hooks or channel shaped hinge leaves which together with the hinge pin form the hinge mechanism, the channel is upwardly open so that the hinge pin rests in the channel to gradually support the lower housing in the open position.

The use of open hooks or open channels as the hinge support allows the lower housing to be detached by separation of the hinge, i.e., raising the hinge pin out of hook channel to separate the upper and lower housings.

Within a luminaire of this general construction, the present invention acts to hold the hinge pin in the channel and maintain the engagement of the hinge sections, i.e., channel and hinge pin. When it is desired to detach the engagement of the hinge sections, the retainer of the present invention is retracted to open the channel and allow the detachment of the lower housing.

The present invention has as its object to provide a hinge retainer which may be readily withdrawn to allow the hinged connection of lower housing and upper housing to be separated.

The present invention provides a generally U-shaped wire spring member which in one position locks the hinge engagement maintaining that engagement. The spring member may be withdrawn from the position embodying that engagement to a second position enabling separation of the hinge sections.

It is a further object of the invention to provide a U-shaped, wire spring, hinge retainer which mates with configurations of a stationary housing structure to firmly maintain the hinge engagement of a second housing by the retainer spring, the retainer being retractable to enable disengagement of the hinge sections and detachment of the second housing.

It is still a further object of the invention to provide for a luminaire housing, a hinge mechanism for joining two housings in a manner allowing separation of the two housings, the hinge mechanism including a retainer which must be removed before the hinge sections can be separated.

DETAILED DESCRIPTION OF THE DRAWINGS

Figure 1:
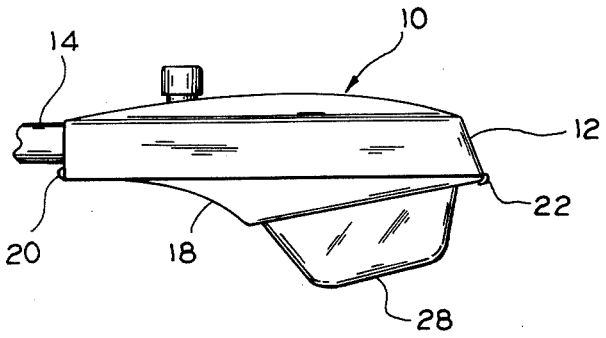
FIG. 1 is a side elevation of a luminaire of a known type to which our invention is applied.

In FIG. 1, there is shown conventional outdoor luminaire 10 comprised of an upper stationary or main housing 12 mounted on the support mast 14 in any conventional manner. A lower housing 18 is hinged to the upper housing 12 at hinge mechanism 20, the hinge mechanisms being at one end of the luminaire, the mast end as shown. A conventional latch 22 holds the lower housing in a closed position relative to the main housing. A refractor or glass bowl 28 protrudes from the lower housing to transmit light from a lamp and reflector structure within the luminaire.

As is conventional, the refractor 28 is suitably secured within an opening in the lower housing 18 and is movable therewith as an assembled part of the lower housing only when the luminaire is open, i.e., with the lower housing pivoted to its open position. Both housings may be formed as castings of suitable metal.

The lower housing 18 may assume three conditions relative to the stationary housing 12. These conditions are the (1) Closed position of FIG. 1; (2) The lower housing in an open condition; and (3) The lower housing being in a fully detached condition.

The hinge mechanism 20 is comprised of an downwardly open channel 30, the channel being secured to and may be integral with one end of the lower housing 18. The channel extends transversely and may be formed by two or more separated hook members (not shown) in place of the single continuous channel 30. The main housing 12 has as its component of the hinge mechanism a laterally extending hinge pin 32 spaced from the adjacent end of the housing by laterally spaced apart tongues 34 which may be integral to the upper housing. Further, the single hinge pin may comprise two integral dowel pins each horizontally extending from its respective tongues 34.

Figure 6:
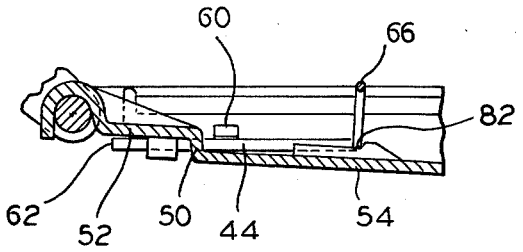
FIG. 6 is a sectional view of the mechanism taken along line 6—6 of FIG. 5.
Figure 7:
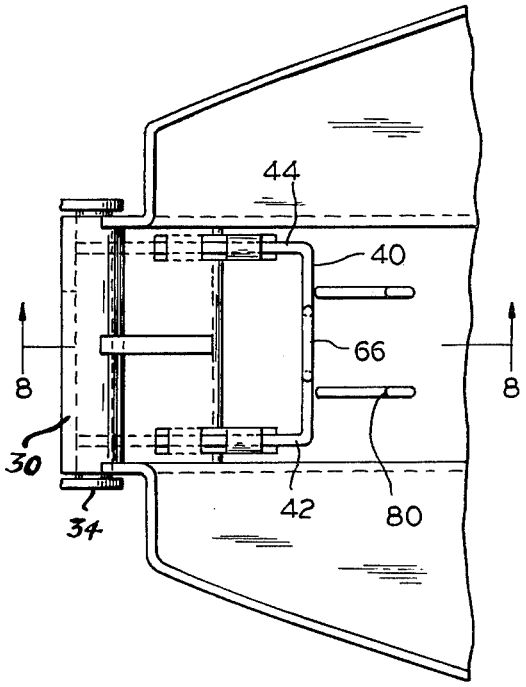
FIG. 7 is a bottom view of FIGS. 3 and 5 with the retainer in its latched condition.

The luminaire structure described to this point is well-known in the art. The present invention is directed to a wire spring, hinge engagement retainer 40. The retainer is essentially U-shaped and has two spaced apart prongs 42 and 44 which normally rest over spaced apart sections of the hinge pin 32 (or pins) and the retainer maintains the engagement of hinge pin in the hinge channel, as shown in FIGS. 6 and 7.

To hold the retainer 40 in place and to facilitate its positioning and removal when desired, various shapes are duly formed in the surfaces of lower housing 18. These forms may be cast into the housing, in their simplest form. The lower housing 18 has a step wall 50 adjacent and parallel to the hinge channel 30, the step wall spacing parallel housing surface walls 52 and 54 in essentially parallel planes. Suitable slotted openings or a single enlarged slot opening are provided in the step vertical extent or wall.

As shown herein, two horizontally elongated slot openings 58 are provided in step wall 50 to allow the legs 42 to penetrate from the luminaire interior to the hinge area.

On opposite sides of the step wall 50, the housing has two sets of paired, aligned, inverted U-shaped protrusions with the base of each U protrusion extending horizontally in opposed directions from the respective U legs to form opposed pockets for capturing the respective retainer prongs. Each leg of each protrusion is affixed to the adjacent housing wall, 52 and 54, respectively, and may be integral therewith as part of the casting of the housing.

Figure 4:
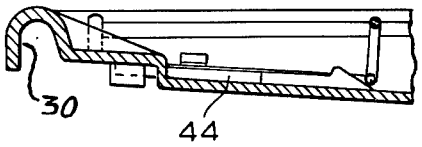
FIG. 4 is a section viewed along line 4—4 of FIG. 3.
Figure 8:
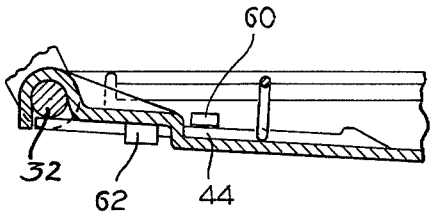
FIG. 8 is a sectional view taken along line 8—8 of FIG. 7.
Figure 5:
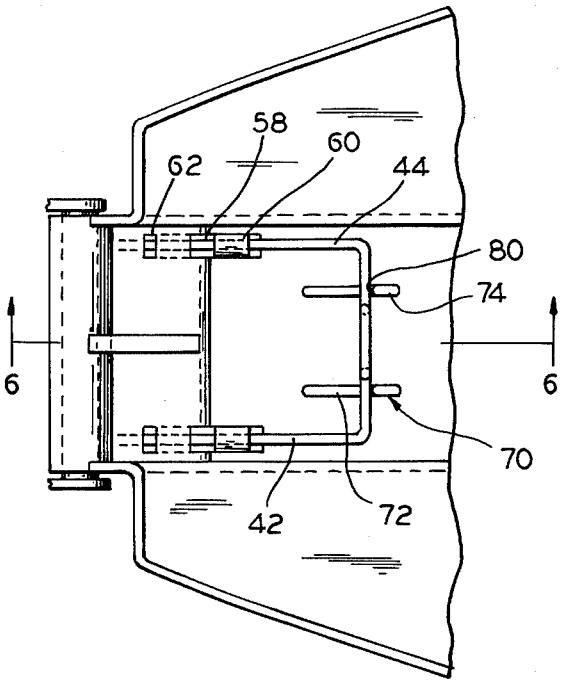
FIG. 5 is a bottom view in elevation similar to that of FIG. 3 with the hinge mechanism engaged and the retainer in its detached position.

For holding a particular prong such as prong 44, as shown in FIGS. 4, 6 and 8, the L shaped protrusions 60 and 62, are oppositely directed to capture and confine the prong 44 between the respective protrusion legs and direct the prong along the plane formed by the housing surface 52. Further, there are provided a pair of stop abutments 70 raised from surface. Abutments 70 have an elongated section 72 directed toward step wall 52 and a shouldered ridge 74 at the further end, sloped downwardly at the rear.

The retainer 40 has a manually graspable handle section 66 formed in the base element. The section 66 is raised from the plane 82 of the retainer transversely intermediate between the retainer prongs 42 and 44, a pair of spaced shoulders 80 being formed in the plane 82 of U-shaped retainer.

Figure 3:
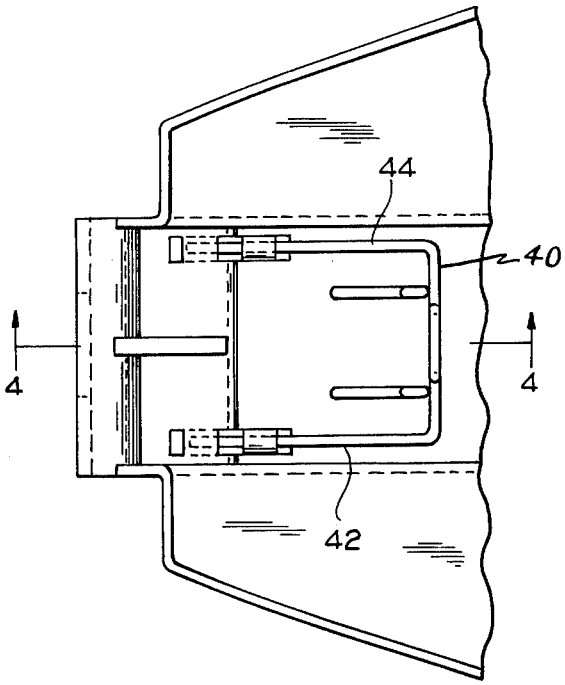
FIG. 3 is a bottom view of a partial section of housing of FIG. 2 with the hinge pin removed and the retainer fully retracted.

In FIGS. 3 and 4 we show the U-shaped retainer fully retracted prior to insertion in the luminaire. The planar shoulders 80 of the retainer are at the rear of ramp walls 82 of the spaced stop abutments 70. The front end (left in FIGS. 3–8) of the retainer prongs is just to the rear (right in FIGS. 3–8) of the front L-shaped protrusions.

In the position of FIGS. 3 and 4, the prongs 42 and 44 are captured in the rear L protrusions by squeezing inwardly of the forward ends and pushing the prong tips thru the openings in the step wall. The protrusion legs hold and the openings guide the prong tips into the step wall openings as the retainer enters the position of FIGS. 3 and 4.

To further complete the mounting of the hinge retainer the handle section 66 is pushed forwardly over the ramp and the retainer prong tips are confined within the extent of forward L protrusions. The shoulders pass over the ramp incline of the stop abutments and rest on elongated section 72, as viewed in FIGS. 5 and 6. In this position, the hinge pin is fully exposed in the channel and may be removed and replaced.

When the hinge pin is to be firmly held in place, the retainer is pushed forwardly until the retainer prong tips are advanced into contact with the remote end wall of the channel which is raised to act as a stop for the forward advance of the retainer tips. In this position, that of FIGS. 7 and 8, the hinge pin is retained in its channel by the prongs. The retainer shoulders rest against the front ends of the stop abutment elongated section. The retainer is held against forward movement by the raised end wall of the channel, held against rearward movement by the abutments front ends and against sidewise movement by the L protrusions.

Figure 2:
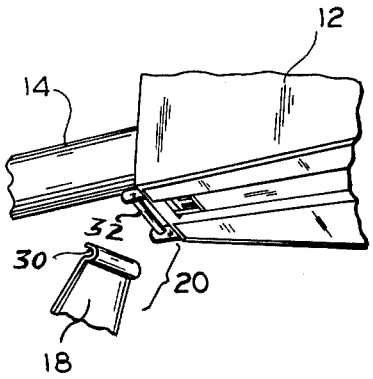
FIG. 2 is a partial perspective view of the hinge mechanism in a detached condition.

In the position of FIGS. 7 and 8, the hinge may pivot from its fully closed position to the open position of FIG. 2 but the hinge pin to channel engagement remains latched by the retainer. The retainer cannot be lifted due to its capture within the L shaped protrusions.

When it is desired that the lower housing be removed, the retainer handle section is grasped and raised onto the abutment elongated section and retracted until the shoulders strike the abutment ramp wall. The prong tips are thereby retracted from their covering relationship with the hinge pin and the hinge pin may be removed from the channel. This position is the retracted position of FIGS. 5 and 6. The retainer is held captive in this position by the abutment wall and the U-shaped protrusions, pending return of the hinge pin for closure of the retainer to the locked position of FIGS. 7 and 8. With the present holding device, the hinge mechanism is held together with the housing in either the open or the closed position. The device may be displaced without the use of any tools to enable detachment of the hinge mechanism and removal of the lens housing when desired. The device is held in place on the main housing awaiting return of the lens housing and the restoration of the hinge mechanism to its retained condition.

We claim:

1. A hinge retainer for use with a luminaire having a stationary housing and a movable housing pivotally hinged to the stationary housing and in which the pivotal hinging is performed by a hinge pin on one of said housings which rests in a hinge receiving channel on said other housing, the invention comprising a hinge retainer on said other housing, said hinge retainer comprising a spring arm extending in a hold position across said channel to hold said hinge pin in said channel, means for confining said retainer in said hold position, said confining means and said retainer cooperatively associated in said hold position to prevent removal of said hinge pin from said hinge channel, said association releasable to enable manual removal of said retainer from said hold position to a retracted position to enable detachment of said hinge pin from said channel.

2. A hinge retainer as claimed in claim 1, in which said retainer comprises a U-shaped member with the two arms of the member extending across said channel to confine the pin therein.

3. A hinge retainer as claimed in claim 2, in which said confining means comprises members forming discontinuous boxes for retaining the arms of said U member and enabling detaching movement of the arms.

4. A hinge retainer as claimed in claim 3, in which said confining means comprises a back-stop for holding the retainer in said hold position and means of said back-stop for holding said retainer in said retracted position.

5. A hinge assembly for a luminaire in which a lens housing is pivotal relative to the main housing to enable access to the luminaire interior and to enable removal of said lens housing by disassociating the members of said hinge assembly, said hinge assembly comprising a channel affixed to one housing, a hinge pin affixed to the other housing and normally resting in said channel, and a hinge retainer for maintaining the association of said pin in said channel, said retainer comprising a rigid projection extending across the opening of said channel to capture said hinge pin in said channel in a manner allowing pivoting of the hinge pin and its housing in the channel relative to its housing, means in said one housing forming a bore for constraining said projection to translatory movement between a first position maintaining the capture of the hinge pin in said channel and a second position enabling release of the hinge pin from said channel to allow removal of said other housing, further means on said one housing providing limit stops for the translatory movement in both said positions, and a grasping handle adjacent the end of said projection remote from said channel to allow manual grasping of said projection to move said projection between said positions.

6. A hinge assembly as claimed in claim 5, in which such retainer comprises a U shaped member in which said projection comprises a first rod, and in which there is a second rod generally parallel to said first rod, with both said rods extending over the channel opening in the retaining position.

7. A hinge assembly as claimed in claim 5 in which said bore is discontinuous, and comprises members integral to said one housing, and in which the channel has a raised wall at the outside thereof for engaging said projection to hold said retainer in the retaining position.

8. A hinge assembly as claimed in claim 6, in which said U shaped member is fabricated of spring rod, and said limit stop means and said bore means are integrally formed on said one housing.

* * * * *